US010829254B2

(12) United States Patent
Barbieri et al.

(10) Patent No.: US 10,829,254 B2
(45) Date of Patent: Nov. 10, 2020

(54) METHOD AND A MACHINE FOR PRODUCING A SEALED PACKAGE

(71) Applicant: Tetra Laval Holdings & Finance S.A., Pully (CH)

(72) Inventors: Marcello Barbieri, Modena (IT); Pietro Martini, Parma (IT); Roberto De Pietri Tonelli, Colombaro di Formigine (IT); Davide Morciano, Modena (IT); Carlo Forcellini, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 16/085,002

(22) PCT Filed: Mar. 2, 2017

(86) PCT No.: PCT/EP2017/054854
§ 371 (c)(1),
(2) Date: Sep. 14, 2018

(87) PCT Pub. No.: WO2017/157676
PCT Pub. Date: Sep. 21, 2017

(65) Prior Publication Data

US 2019/0084708 A1 Mar. 21, 2019

(30) Foreign Application Priority Data

Mar. 17, 2016 (EP) ..... 16160796

(51) Int. Cl.
*B65B 31/00* (2006.01)
*B65B 43/10* (2006.01)
(Continued)

(52) U.S. Cl.
CPC ..... *B65B 43/10* (2013.01); *B65B 9/2049* (2013.01); *B65B 9/2056* (2013.01); *B65B 41/04* (2013.01);
(Continued)

(58) Field of Classification Search
CPC ..... B65B 43/10; B65B 61/24; B65D 3/02
(Continued)

(56) References Cited

U.S. PATENT DOCUMENTS 3,857,223 A 12/1974 Dominici
5,636,785 A * 6/1997 Kalberer ..... B65D 5/067 229/125.15
2013/0292459 A1* 11/2013 Okezawa ..... B65B 9/2056 229/115

FOREIGN PATENT DOCUMENTS

CN 101784450 A 7/2010
CN 102099256 A 6/2011
(Continued)

OTHER PUBLICATIONS

International Search Report and Written Opinion corresponding PCT Application No. PCT/EP2017/054854 dated Apr. 11, 2017 (15 pages).
(Continued)

*Primary Examiner* — Chelsea E Stinson
(74) *Attorney, Agent, or Firm* — Finnegan, Henderson, Farabow, Garrett & Dunner, L.L.P.

(57) ABSTRACT

A method for producing a sealed package for a product may include: providing a sheet packaging material having a crease pattern with a first transverse crease line, a second transverse crease line, and a plurality of further crease lines interposed between the first and second transverse crease lines, the further crease lines extending transversely to the first and second transverse crease lines; obtaining a sealed
(Continued)

preliminary packaging unit from the sheet packaging material, the sealed preliminary packaging unit having a preset inner volume and containing the product; exerting a forming action on the sealed preliminary packaging unit so as to fold the sheet packaging material defining the sealed preliminary packaging unit and obtain a package therefrom. During the step of obtaining the sealed preliminary packaging unit, the sheet packaging material may be processed without being folded along the further crease lines.

19 Claims, 6 Drawing Sheets

(51) Int. Cl.

| | |
|---|---|
| ***B65B 61/24*** | (2006.01) |
| ***B65B 9/20*** | (2012.01) |
| ***B65B 41/04*** | (2006.01) |
| *B65B 55/10* | (2006.01) |

(52) U.S. Cl.
CPC ..... *B65B 61/24* (2013.01); *B65B 31/00* (2013.01); *B65B 55/103* (2013.01)

(58) Field of Classification Search
USPC ..... 53/456
See application file for complete search history.

(56) References Cited

FOREIGN PATENT DOCUMENTS

| | | |
|---|---|---|
| CN | 103228543 A | 7/2013 |
| EP | 2 042 433 | 4/2009 |
| EP | 2 468 634 | 6/2012 |
| EP | 2 650 221 | 10/2013 |
| WO | WO 2007-114752 | 10/2007 |
| WO | WO 2009-141389 | 11/2009 |
| WO | WO 2010-084660 | 7/2010 |
| WO | WO 2012/077596 A1 | 6/2012 |

OTHER PUBLICATIONS

Office Action in corresponding Chinese Application No. 201780007607.4, dated Mar. 27, 2019 (7 pages).

* cited by examiner

METHOD AND A MACHINE FOR PRODUCING A SEALED PACKAGE

CROSS-REFERENCE TO RELATED PATENT APPLICATIONS

This is a National Phase of International Application No. PCT/EP2017/054854, filed Mar. 2, 2017, which claims the benefit of European Application No. 16160796.5 filed Mar. 17, 2016. The entire contents of the above-referenced applications are expressly incorporated herein by reference.

TECHNICAL FIELD

The invention relates to a method and a machine for producing a sealed package for products, particularly pourable food products. The method and the machine according to the invention are particularly suitable for producing sealed packages from sheet packaging materials.

BACKGROUND OF INVENTION

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by folding and sealing laminated strip packaging material. The packaging material has a multilayer structure comprising a base layer, e.g. of paper, covered on both sides with layers of heat-sealable plastic material, e.g. polyethylene. In the case of aseptic packages for long-storage products, such as UHT milk, the packaging material also comprises a layer of oxygen-barrier material, e.g. an aluminium foil, which is superimposed on a layer of heat-sealable plastic material, and is in turn covered with another layer of heat-sealable plastic material forming the inner face of the package eventually contacting the food product.

The package is produced starting from a basic unit of packaging material, which is normally conformed as a portion of a web of packaging material advanced through the packaging machine along an advancement direction. Alternatively, the packaging material may be cut into blanks, which are formed into packages on forming spindles, and the packages are then filled with the food product and sealed. In this case, the basic unit from which the package is produced is configured as a precut blank.

The basic unit of packaging material used to form a package has usually a rectangular shape with two main dimensions, namely a major dimension or width and a minor dimension or length.

If the basic unit is a portion of a web of packaging material, the advancement direction along which the sheet packaging material is advanced on the packaging machine is normally parallel to the length of the basic unit.

The web of packaging material is sterilized on the packaging machine, and subsequently maintained in a closed, sterile environment. In this environment, opposite longitudinal borders of the sheet packaging material are sealed together to form a continuous tube, which is filled with a sterilized or sterile-processed food product.

Known packaging machines comprise two chain conveyors defining respective endless paths, each of which supports a plurality of jaws. The two paths comprise respective branches substantially facing and parallel to each other, and between which the tube of packaging material is fed. The jaws on one conveyor cooperate, along the facing branches of the respective paths, with corresponding jaws on the other conveyor to grip the tube and advance the latter along the advancement direction.

On other known packaging machines, the jaws—instead of being supported by opposite chain conveyors—can be supported by other kinds of driving devices, for example two shafts that move the jaws forwards and backwards.

Each pair of cooperating jaws is provided with a sealing device for sealing the tube along a transverse sealing band arranged transversely to the advancement direction. Each pair of cooperating jaws is further provided with a cutting device for cutting the tube through the transverse sealing band. Preliminary packaging units, each of which is completely sealed and filled with the required amount of product, can thus be separated from the tube.

The preliminary packaging units formed by the jaws have a shape that is different from the final shape of the finished package. The finished package is given its final shape in a folding unit provided downstream of the jaws.

However, the jaws exert a forming action on the preliminary packaging unit by starting to fold the sheet packaging material along a plurality of creases, some of which are arranged along the advancement direction, i.e. are parallel to the length of the sheet packaging material. To this end, each jaw is provided with a half shell hinged or connected thereto. Two facing half shells mutually cooperate to surround the tube of packaging material as pairs of opposite jaws seal the latter. Each half shell is provided with a concave forming surface intended to interact with the packaging material.

Thus, the cross-section of the preliminary packaging unit formed by the jaws is quite similar to the cross-section of the finished package.

The machines disclosed above have the drawback that the sheet packaging material is significantly stressed, since it is subjected to two distinct forming operations, the first of which is carried out by the half shells associated to the jaws, while the second is carried out in the final folding unit provided downstream of the jaws. This might originate micro-cracks or similar defects on the sheet packaging material.

In addition to transversely sealing, cutting and forming the sheet packaging material, the jaws and the half shells of known machines have also the function of isolating a preset volume inside the preliminary packaging unit. When the longitudinal seal and both the transverse seals of the preliminary packaging unit have been completed, a preset inner volume is defined inside the preliminary packaging unit. This inner volume, which will not be affected by the further forming operations carried out downstream of the jaws in order to obtain the finished package, determines the quantity of product that can be contained inside the package.

The weight of product with which a preliminary packaging unit is effectively filled can be less than the weight of product corresponding to the nominal maximum inner volume that can be defined inside a preliminary packaging unit (or inside a finished package, which is the same). To this end, the preliminary packaging unit can be squeezed to a certain extent, before being completely sealed. Of course, the squeezing action exerted on the preliminary packaging unit before sealing the latter cannot exceed a certain threshold, in order not to jeopardize quality and appearance of the finished package.

As an alternative, a certain amount of inert gas, e.g. nitrogen, can be injected inside the preliminary packaging unit before completely sealing the latter. The inert gas is used to fill a fraction of volume of the sealed preliminary packaging unit, so that—for a given volume of the sealed preliminary packaging unit—the weight of product contained inside the latter can be reduced.

However, injecting an inert gas inside a preliminary packaging unit complicates the packaging machine and the packaging process. Furthermore, on certain kinds of food products, the inert gas injected inside the package may have negative effects.

Although the parallelepiped-shaped package that has been mentioned above is one of the most common sealed packages for containing food products, other kinds of package shapes can also be produced. In particular, packages provided with so-called design elements are known. These packages may comprise at least one longitudinal border zone that, instead of being rectilinear, has a three-dimensional shape defined for example by two non-straight crease lines extending between respective common end points.

Producers of packaged products normally appreciate being capable of manufacturing differently shaped packages on the same machine. This allows the producers to increase flexibility on the market, by offering a number of different package shapes to their customers.

Furthermore, by changing the shape of the finished package, the volume of product that can be contained inside the package can also be varied to a certain extent. This is due to the fact that differently shaped packages have different internal volumes and hence are capable of containing different quantities of product.

Changing the shape of the package is therefore a manner of increasing flexibility in the volume of product with which the package can be filled.

However, changing the configuration of a packaging machine so that the packaging machine, which was previously producing a package having a certain shape, becomes capable of producing a package having a different kind of shape, is a quite complicated and time consuming operation. This is due to the large number of components that need to be replaced, as well as to the required mechanical and electric adjustments. Hence, changing the shape of the package to be produced requires the packaging machine to be stopped for long periods, with consequent loss in productivity.

DISCLOSURE OF INVENTION

An object of the invention is to improve known methods for producing sealed packages for products, particularly pourable food products.

A further object is to increase flexibility in the volume of product with which a sealed package may be filled.

Another object is to increase flexibility in the shape of sealed packages that can be produced by a packaging machine.

Another object is to simplify the operations that need to be carried out in order to change the configuration of a packaging machine, so that the machine, which was previously producing a package having a certain shape, becomes capable of producing a package having a different shape.

A further object is to improve the forming operations for obtaining a sealed package containing a product from a sheet packaging material.

In particular, it is desired to reduce stress on the sheet packaging material during the forming operations.

In a first aspect of the invention, there is provided a method for producing a sealed package for a product, comprising the following steps:

providing a sheet packaging material having a crease pattern, the crease pattern comprising at least a first transverse crease line and a second transverse crease line, the crease pattern further comprising a plurality of further crease lines interposed between the first transverse crease line and the second transverse crease line, said further crease lines extending transversely to the first transverse crease line and to the second transverse crease line;

obtaining a sealed preliminary packaging unit from the sheet packaging material, the sealed preliminary packaging unit having a preset inner volume and containing the product;

exerting a forming action on the sealed preliminary packaging unit so as to fold the sheet packaging material defining the sealed preliminary packaging unit and obtain a package therefrom, wherein, during the step of obtaining the sealed preliminary packaging unit, the sheet packaging material is processed without being folded along said further crease lines.

The method according to the first aspect of the invention increases flexibility in the kind of packages that can be produced on a packaging machine.

In the method according to the invention, the step of obtaining the sealed preliminary packaging unit is carried out without folding the sheet packaging material along said further crease lines. Hence, the devices that create the sealed preliminary packaging unit may have a shape that is not strictly correlated to the cross-section of the finished package.

As a consequence, if it is desired to produce packages having a cross-section that differs—to a certain extent—from the cross-section of the previously produced packages, changes to the device that creates the sealed preliminary packaging unit may be unnecessary or anyhow strongly reduced.

This greatly simplifies the operations that need to be carried out in order to change the configuration of the packaging machine, so that a machine, which was previously producing a certain kind of package, can be made capable of producing a different kind of package in a relatively short time.

Consequently, the machine can easily be converted from production of a certain kind of package to production of a differently shaped package. The range of sealed packages that can be offered by a producer of packaged products is therefore widened.

The method according to the first aspect of the invention also increases flexibility in the volume of product that can be used to fill a package.

By obtaining the sealed preliminary packaging unit without folding the sheet packaging material along the above mentioned further crease lines, the sealed preliminary packaging unit may have, in a central region thereof, a cross-section that is quite different from the cross-section of the finished package. Hence, when obtaining the sealed preliminary packaging unit, volume of the latter can be better controlled according to the needs of the producer.

Consequently, the quantity of product filling a package can be varied to a certain extent, without injecting an inert gas inside the package.

Furthermore, stress on the sheet packaging material is significantly reduced, because certain crease lines of the sheet packaging material, namely the further crease lines mentioned above, are only folded once, namely after the sealed preliminary packaging unit has been obtained.

In a second aspect of the invention, there is provided a machine for producing a sealed package for a product, comprising:

an advancement device for advancing a sheet packaging material having a crease pattern, the crease pattern comprising at least a first transverse crease line and a second transverse crease line, the crease pattern further comprising a plurality of further crease lines interposed between the first transverse crease line and the second transverse crease line, said further crease lines extending transversely to the first transverse crease line and to the second transverse crease line;

a volume defining arrangement for obtaining a sealed preliminary packaging unit from the sheet packaging material, the sealed preliminary packaging unit containing the product, a preset inner volume being defined inside the sealed preliminary packaging unit;

a forming arrangement for exerting a forming action on the sealed preliminary packaging unit so as to fold the sheet packaging material defining the sealed preliminary packaging unit and obtain a package therefrom, wherein the volume defining arrangement is configured to process the sheet packaging material without folding the sheet packaging material along said further crease lines.

The machine according to the second aspect of the invention allows obtaining the advantages and effects that have been previously described with reference to the method according to the first aspect of the invention.

BRIEF DESCRIPTION OF THE DRAWINGS

The invention will be better understood and carried out with reference to the enclosed drawings, which show some exemplifying and non limiting embodiments thereof, wherein.

DETAILED DESCRIPTION OF PREFERRED EMBODIMENTS

Figure 1:
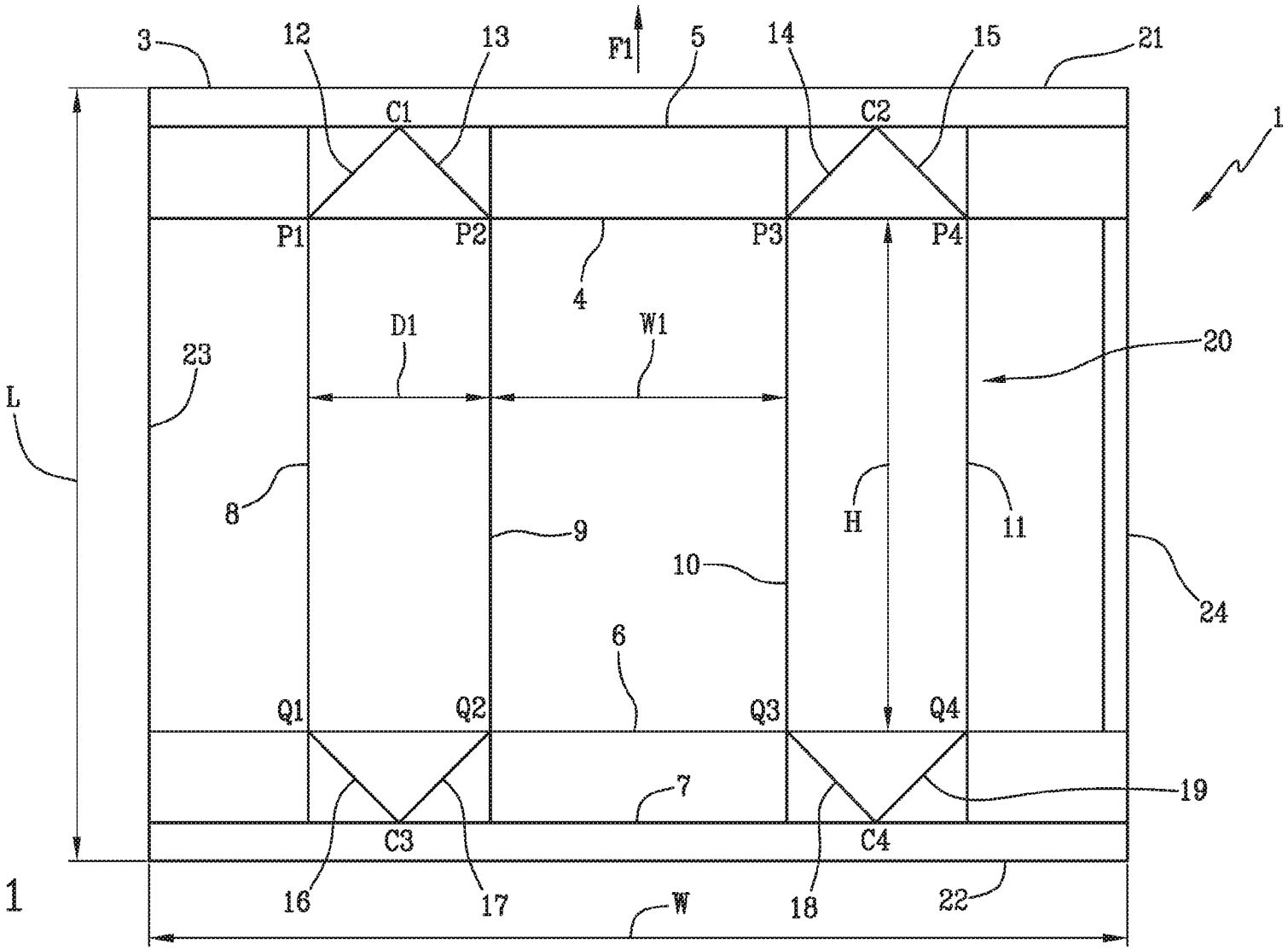
FIG. 1 is a plan view showing a basic unit for forming a package according to a first conformation.
Figure 3:
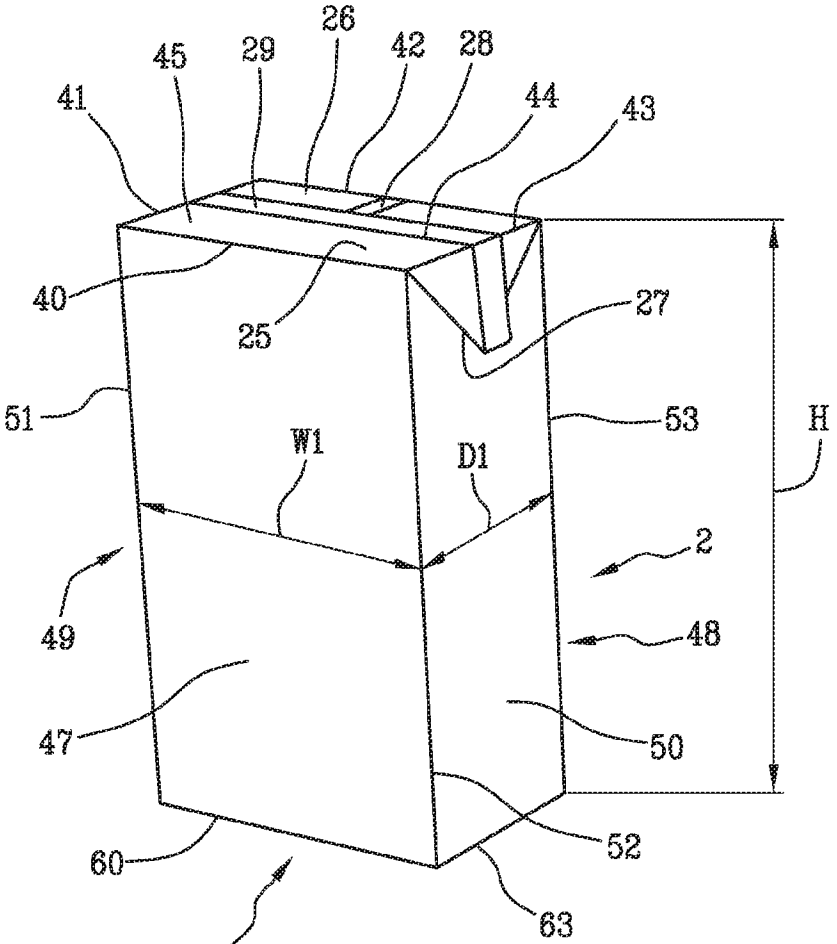
FIG. 3 is a schematic perspective view showing the package according to the first conformation.

FIG. 1 shows a sheet packaging material 1 for producing a package 2 according to a first conformation as shown in FIG. 3. The package 2 is a sealed package particularly suitable for containing a product, for example a pourable food product.

The sheet packaging material 1 may be configured as a basic unit 3 that can be used to produce the package 2. The basic unit 3 may be a portion of a web of packaging material comprising a succession of basic units.

If the basic unit 3 is a portion of a web of packaging material, this web, which comprises a succession of basic units 3, is:

folded to form a vertical tube and longitudinally sealed;

filled continuously with the food product; and sealed transversely and cut into sealed preliminary packaging units, which are then folded to form respective packages.

The sheet packaging material 1 has a multilayer structure comprising a base layer, e.g. of paper, for stiffness, and a number of lamination layers covering both sides of the base layer.

For example, the lamination layers may comprise a first layer of oxygen-barrier material, e.g. an aluminum foil, and a number of second layers of heat-sealable plastic material covering both sides of both the base layer and the first layer. In other words, such solution comprises, in succession and from the side eventually forming the inside of a package, a layer of heat-sealable plastic material, a layer of barrier material, another layer of heat-sealable plastic material, the base layer, and another layer of heat-sealable plastic material.

The inner layer of heat-sealable plastic material contacting the food product, in use, may, for example, be made of strong, in particular, high-stretch, metallocene-catalyzed, low-linear-density (LLD) polyethylene.

Normally, the layers of heat-sealable plastic material are laminated on the base layer in a melted state, with successive cooling.

As a possible alternative, at least the inner layers of plastic material may be provided as prefabricated films, which are then laminated on the base layer.

The basic unit 3 has a crease pattern 20, comprising a number of crease lines defining respective fold lines, along which the sheet packaging material 1 is folded to form a finished package.

The basic unit 3 has a quadrilateral shape, particularly a rectangular or square shape. The basic unit 3 is delimited by a first transverse border 21 and by a second transverse border 22, which are parallel to one another and bound opposite sides of the basic unit 3. The basic unit 3 is further delimited by a first longitudinal border 23 and by a second longitudinal border 24, which are parallel to one another and bound opposite sides of the basic unit 3. The first transverse border 21 and the second transverse border 22 are each interposed between the first longitudinal border 23 and the second longitudinal border 24. The first transverse border 21 and the second transverse border 22 extend transversely, in particular perpendicularly, to the first longitudinal border 23 and to the second longitudinal border 24.

The adjectives "transverse" and "longitudinal" are used in this context to indicate whether the line or border at issue will be arranged in a transverse direction or respectively in a longitudinal direction in the finished package.

The basic unit 3 has a first dimension or length L and a second dimension or width W. In the example shown, the width W is the linear dimension of the first transverse border 21 and of the second transverse border 22, whereas the length L is the linear dimension of the first longitudinal border 23 and of the second longitudinal border 24.

If the basic unit 3 is a portion of a continuous web of packaging material, the latter is intended to be advanced on a packaging machine along an advancement direction A1 that is parallel to the length L.

The crease pattern 20 comprises a first transverse crease line or top transverse crease line 4, intended to form a plurality of top edges 40, 41, 42, 43 of the package 2. The top transverse crease line 4 is parallel to the first transverse border 21 and to the second transverse border 22 of the basic unit 3.

The crease pattern 20 comprises a further top transverse crease line 5, which is parallel to the top transverse crease line 4. The further top transverse crease line 5 is closer to the first transverse border 21 than the top transverse crease line 4. The further top transverse crease line 5 is intended to allow a top transverse sealing band 44 of the package 2 to be folded.

The crease pattern 20 further comprises a second transverse crease line or bottom transverse crease line 6, intended to form a plurality of bottom edges of the package 2, only two of which are shown in FIG. 3 and are indicated by numbers 60, 63.

The bottom transverse crease line 6 is parallel to the top transverse crease line 4, as well as to the first transverse border 21 and to the second transverse border 22 of the basic unit 3.

A further bottom transverse crease line 7, which is parallel to the bottom transverse crease line 6, is also provided. The further bottom transverse crease line 7 is intended to allow a bottom transverse sealing band of the package 2 to be folded.

The adjectives "top" and "bottom" are used in this context to indicate whether the line at issue will be arranged in a top region or respectively in a bottom region of the finished package.

In the example shown, the top transverse crease line 4, the further top transverse crease line 5, the bottom transverse crease line 6 and the further bottom transverse crease line 7 are each configured as a straight crease line. However, the transverse crease lines 4, 5, 6, 7 may also have shapes that are different from those shown in FIG. 1. For example, the top transverse crease line 4 may be conformed as a sequence of straight segments that are tilted relative to each other. In this case, a package having a slanted top wall can be obtained.

The crease pattern 20 comprises a plurality of further crease lines that may include:

a longitudinal crease line 8;

a first longitudinal crease line 9;

a second longitudinal crease line 10;

a further longitudinal crease line 11.

In the example shown, the longitudinal crease line 8, the first longitudinal crease line 9, the second longitudinal crease line 10 and the further longitudinal crease line 11 are parallel to one another.

The longitudinal crease line 8, the first longitudinal crease line 9, the second longitudinal crease line 10 and the further longitudinal crease line 11 are arranged transversely, in particular perpendicularly, to the top transverse crease line 4 and to the bottom transverse crease line 6.

The longitudinal crease line 8, the first longitudinal crease line 9, the second longitudinal crease line 10 and the further longitudinal crease line 11 extend continuously from the further bottom transverse crease line 7 to the further top transverse crease line 5.

The first longitudinal crease line 9 and the second longitudinal crease line 10 are adjacent to one another and are interposed between the longitudinal crease line 8 and the further longitudinal crease line 11.

The longitudinal crease line 8, the first longitudinal crease line 9, the second longitudinal crease line 10 and the further longitudinal crease line 11 are intended to form a plurality of longitudinal edges of the package 2, only three of which are shown in FIG. 3 and are indicated by numbers 51, 52, 53.

The longitudinal crease line 8, the first longitudinal crease line 9, the second longitudinal crease line 10 and the further longitudinal crease line 11 intersect the top transverse crease line 4 respectively at points P1, P2, P3, P4. The longitudinal crease line 8, the first longitudinal crease line 9, the second longitudinal crease line 10 and the further longitudinal crease line 11 intersect the bottom transverse crease line 6 respectively at points Q1, Q2, Q3, Q4.

The crease pattern 20 further comprises:

a first oblique crease line 12 and a second oblique crease line 13 that, respectively from points P1, P2 converge in a common point C1 on the further top crease line 5;

a further first oblique crease line 14 and a further second oblique crease line 15 that, respectively from points P3, P4 converge in a common point C2 on the further top crease line 5;

a first tilted crease line 16 and a second tilted crease line 17 that, respectively from points Q1, Q2 converge in a common point C3 on the further bottom crease line 7;

a further first tilted crease line 18 and a further second tilted crease line 19 that, respectively from points Q3, Q4 converge in a common point C4 on the further bottom crease line 7.

The first oblique crease line 12 and the second oblique crease line 13 are intended to define, together with a portion of the top transverse crease line 4 interposed between points P1, P2, a flat, substantially triangular lateral top flap of packaging material. Similarly, the further first oblique crease line 14 and the further second oblique crease line 15 are intended to define, together with a portion of the top transverse crease line 4 interposed between points P3, P4, a flat, substantially triangular further lateral top flap 27 of packaging material. The lateral top flap and the further lateral top flap 27 are intended to be folded coplanar with and respectively onto opposite side walls of the package 2.

The first tilted crease line 16 and the second tilted crease line 17 are intended to define, together with a portion of the bottom transverse crease line 6 interposed between points Q1, Q2, a flat, substantially triangular bottom flap of packaging material. Similarly, the further first tilted crease line 18 and the further second tilted crease line 19 are intended to define, together with a portion of the bottom transverse crease line 6 interposed between points Q3, Q4, a flat, substantially triangular further bottom flap of packaging material. The triangular bottom flap and the further triangular bottom flap are intended to be folded coplanar with and respectively onto opposite regions of a bottom wall of the package 2.

As shown in FIG. 3, the package 2 according to the first conformation, which is obtained from the basic unit 3, comprises a top wall 45, delimited by the top edges 40, 41, 42, 43.

The package 2 further comprises a bottom wall 46, opposite the top wall 45 and delimited by four bottom edges, only two of which (60, 63) are visible in FIG. 3. In the example shown, the top wall 45 is parallel to the bottom wall 46. However, this condition is not essential.

The package 2 further comprises a front wall 47, interposed between the top wall 45 and the bottom wall 46. The front wall 47 is delimited by the bottom edge 60, the top edge 40 and the longitudinal edges 51, 52.

A back wall 48 is further provided, opposite the front wall 47. The back wall 48 is delimited by the top edge 42, a bottom edge that is not visible in FIG. 3, the longitudinal edge 53 and a further longitudinal edge that is not visible in FIG. 3.

In the example shown, the front wall 47 and the back wall 48 are parallel to one another.

The package 2 further comprises a side wall 49, interposed between the front wall 47 and the back wall 48. The side wall 49 is delimited by the longitudinal edge 51, the top edge 41, a bottom edge and a further longitudinal edge that are not visible in FIG. 3. The side wall 49 may be perpendicular to the front wall 47 and to the back wall 48.

The package 2 comprises a further side wall 50, opposite the side wall 49, delimited by two longitudinal edges 52, 53, the top edge 43 and the bottom edge 63.

The further side wall 50 is interposed between the front wall 47 and the back wall 48. In the example shown, the further side wall 50 is parallel to the side wall 49 and hence perpendicular to the front wall 47 and to the back wall 48.

The package 2 according to the first conformation further comprises a top transverse sealing band 44 that extends across the top wall 45, between opposite top edges 41, 43.

A similar bottom transverse sealing band, which is not shown in FIG. 3, extends across the bottom wall 46, between opposite lower edges.

The top transverse sealing band 44 divides the top wall 45 into a first wall portion 25 and a second wall portion 26. The first wall portion 25, which is adjacent to the front wall 47 and bounded by the top edge 40, defines an area on which a reclosable opening device may be applied. The opening device, which is not shown, may be made of a plastic material.

The opening device is applied to the package 2 by conventional fastening systems, such as adhesives, or by microflame, electric-current-induction, ultrasound, laser, or other heat-sealing techniques. The opening device may also be directly moulded on the sheet packaging material 1.

The second wall portion 26, which is adjacent to the back wall 48 and bounded by the top edge 42, comprises, in a center region thereof, an end portion of a flat longitudinal sealing band 28 of package 2.

More specifically, the longitudinal sealing band 28 extends perpendicularly between the top transverse sealing band 44 and the bottom transverse sealing band, and substantially along the centerline of the back wall 48.

The top transverse sealing band 44 extends beyond the top wall 45 into respective flat, substantially triangular lateral top flaps 27 (only one of which is shown in FIG. 3) of packaging material folded coplanar with and respectively onto the side wall 49 and the further side wall 50.

The top transverse sealing band 44 also forms, lengthwise, a rectangular flat top tab 29 projecting from portions 25, 26 and from lateral top flaps 27 and folded onto the second wall portion 26 along a bend line formed at the base of top tab 29.

Similarly, the bottom transverse sealing band divides the bottom wall 46 into two wall portions, one of which is adjacent to the back wall 48 and comprises, in a central region thereof, an end portion of the longitudinal sealing band 28.

The bottom transverse sealing band comprises a main portion and a pair of end portions, which are arranged on opposite lateral sides of the main portion. The main portion is folded onto the bottom wall 46 while the end portions form two respective flat, substantially triangular lateral bottom flaps of packaging material folded over the main portion.

In conclusion, the package 2 according to the first conformation has a substantially parallelepiped shape.

The package 2 has three main dimensions, namely a height H, a width W1 and a depth D1.

The height H, in the example shown, is the distance between the bottom wall 46 and the top wall 45.

The height H is also equal to the distance between the top transverse crease line 4 and the bottom transverse crease line 6 on the sheet packaging material 1.

The width W1, in the example shown, is the distance between the side wall 49 and the further side wall 50. The width W1 is also equal to the distance between the first longitudinal crease line 9 and the second longitudinal crease line 10 on the sheet packaging material 1.

The depth D1, in the example shown, is the distance between the front wall 47 and the back wall 48. The depth D1 is also equal to the distance between the longitudinal crease line 8 and the first longitudinal crease line 9 (or between the second longitudinal crease line 10 and the further crease line 11, which is the same).

Since the package 2 has a substantially constant cross-section along its height H, the width W1 and the depth D1 are substantially constant in any cross-section taken perpendicularly to the longitudinal edges 51, 52, 53.

Figure 2:
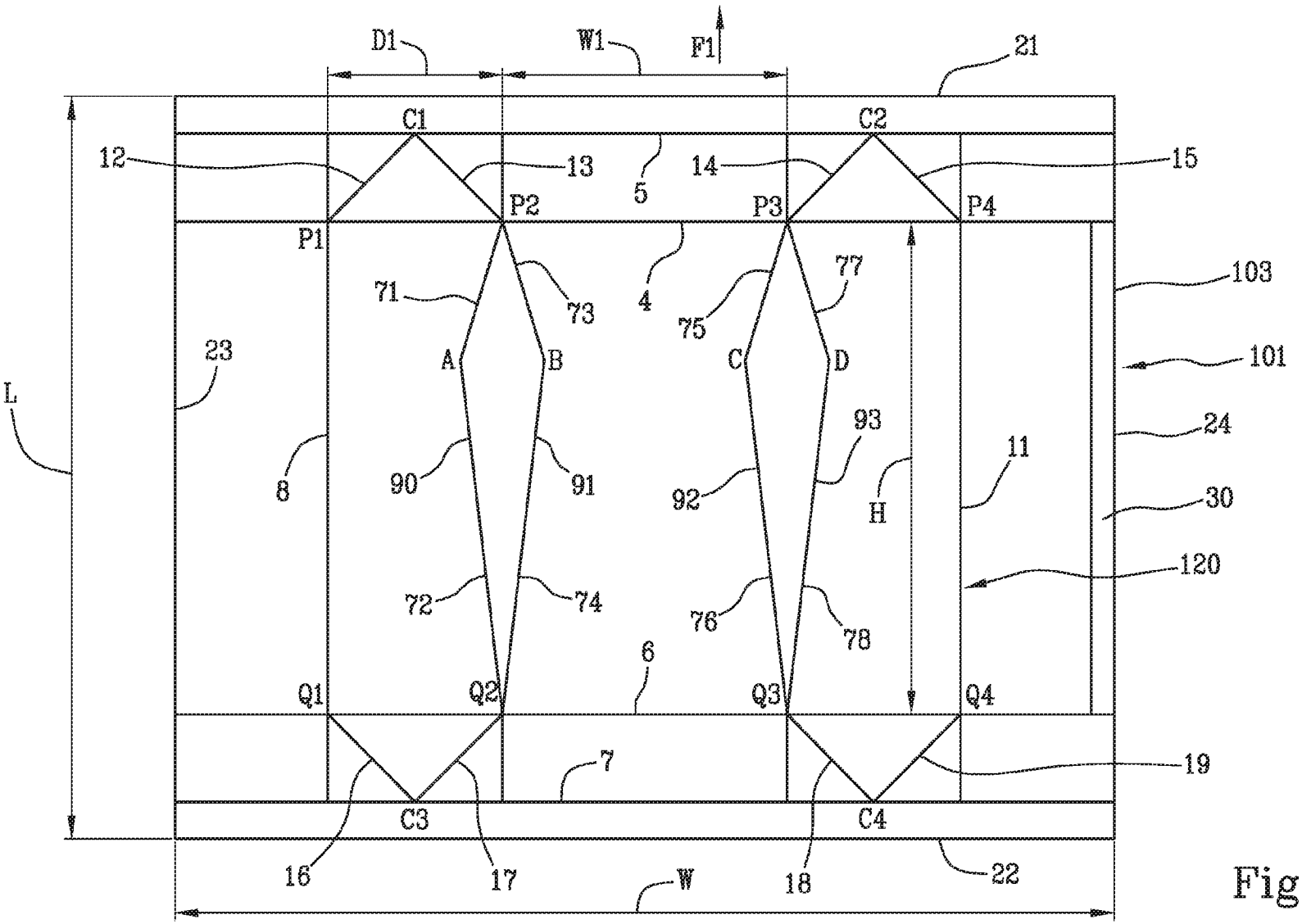
FIG. 2 is a plan view showing a basic unit for forming a package according to a second conformation.
Figure 4:
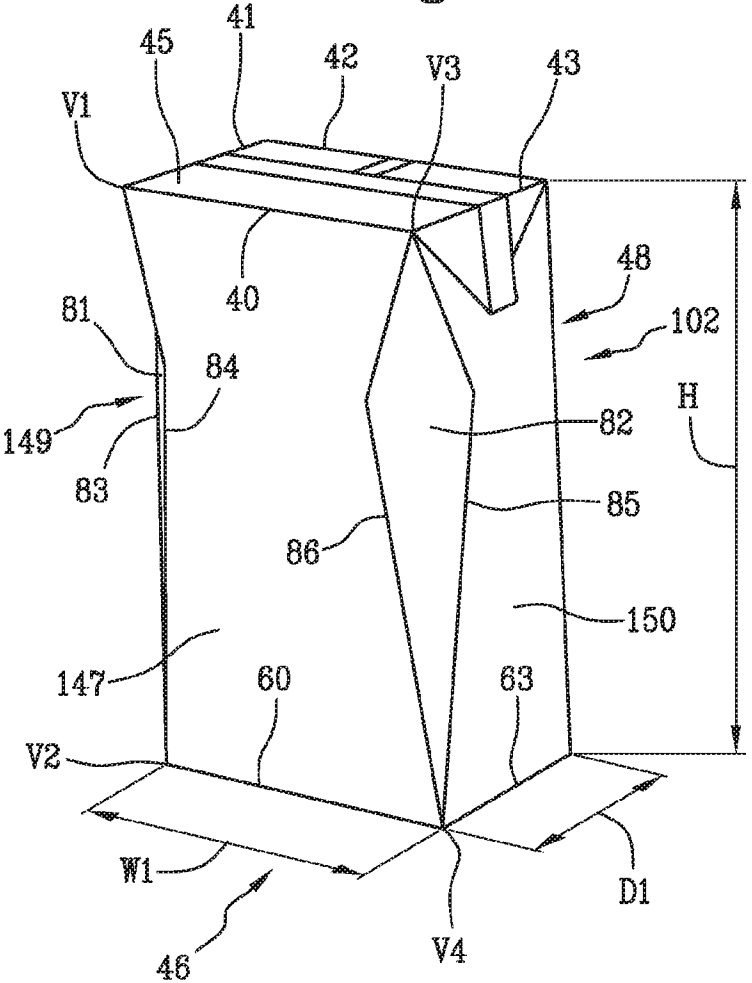
FIG. 4 is a schematic perspective view showing the package according to the second conformation.

FIG. 2 shows a sheet packaging material 101 that can be used to produce a package 102 according to a second conformation, i.e. a package 102 of the kind shown in FIG. 4.

The sheet packaging material 101 is configured as a basic unit 103 that can be used to produce the package 102. The basic unit 103 may be a portion of a web of packaging material comprising a succession of basic units.

Like the basic unit 3 shown in FIG. 1, the basic unit 103 has a quadrilateral shape, particularly a rectangular or square shape.

In other words, the basic units 3, 103 have the same shape.

The basic unit 103 has a first dimension or length L and a second dimension or width W. The length L and the width W of the basic unit 103 are the same as the length L and the width W of the basic unit 3. In other words, the basic unit 3 and the basic unit 103 have the same overall dimensions. If the basic unit 3 were laid over the basic unit 103, the two basic units would completely overlap, as far as their outer dimensions are concerned.

The parts of the basic unit 103 that are common to the basic unit 3 will be indicated by the same reference numbers that have been used in FIG. 1 and will not be described in detail herebelow.

The basic unit 103 differs from the basic unit 3 due to its crease pattern 120, which is not identical to the crease pattern 20 of the basic unit 3.

The crease pattern 120 differs from the crease pattern 20 mainly because it comprises, in place of the first longitudinal crease line 9, a pair of longitudinal crease lines including a first crease line 90 and a second crease line 91.

The first crease line 90 and the second crease line 91 may be concave crease lines, with respective concavities facing each other.

The first crease line 90 comprises a succession of two straight segments, namely a first straight segment 71 and a further first straight segment 72, which intersect in a point A. Similarly, the second crease line 91 comprises a succession of two straight segments, namely a second straight segment 73 and a further second straight segment 74, which intersect in a point B.

The first straight segment 71 and the second straight segment 73 both originate in point P2 and diverge towards points A and B respectively.

The further first straight segment 72 and the further second straight segment 74 both originate in point Q2 and diverge from point Q2 towards points A and B respectively.

The first crease line 90 and the second crease line 91 can be symmetrical relative to a straight line connecting points P2 and Q2.

The distance between the top transverse crease line 4 and points A and B is less than the distance between the bottom transverse crease line 6 and points A and B.

The basic unit 103 further comprises, in place of the second longitudinal crease line 10, a pair of further longitudinal crease lines including a further first crease line 92 and a further second crease line 93.

The further first crease line 92 comprises a succession of two straight segments 75, 76 that intersect in a point C. Similarly, the further second crease line 93 comprises a succession of two further straight segments 77, 78 that intersect in a point D. The segments 76, 78 diverge from point Q3 respectively towards points C and D. The segments 75, 77 diverge from point P3 towards points C and D.

The further first crease line 92 and the further second crease line 93 may have the same shape and dimensions as the first crease line 90 and the second crease line 91 respectively.

By folding the basic unit 103 along the crease lines of the crease pattern 120, it is possible to obtain a package according to a second conformation, namely the package 102 shown in FIG. 4.

The parts of the package 102 that are common to the package 2 will be indicated by the same reference numbers that have been used in FIG. 3 and will not be described in detail herebelow.

The package 102 differs from the package 2 mainly because it comprises, in place of the straight longitudinal edges 51, 52, respective longitudinal border zones that are not shaped as sharp, rectilinear edges.

In particular, the package 102 comprises, in place of the straight longitudinal edges 51, 52, respectively a first corner panel 81 and a second corner panel 82.

The first corner panel 81 is interposed between a front wall 147 and a side wall 149 of the package 102. The first corner panel 81 is delimited by a first border 83, adjacent to the side wall 149, and by a second border 84, adjacent to the front wall 147.

The first border 83 is obtained by folding the basic unit 103 along the first crease line 90, whereas the second border 84 is obtained by folding the basic unit 103 along the second crease line 91. Hence, the first corner panel 81 corresponds to the region interposed between the first crease line 90 and the second crease line 91 of the basic unit 103.

The second corner panel 82 is interposed between the front wall 147 and a further side wall 150 of the package 102. The second corner panel 82 is delimited by a further first border 85, adjacent to the further side wall 150, and by a further second border 86, adjacent to the front wall 147.

The further first border 85 is obtained by folding the basic unit 103 along the further second crease line 93, whereas the further second border 86 is obtained by folding the basic unit 103 along the further first crease line 92. Hence, the second corner panel 82 corresponds to the region interposed between the further first crease line 92 and the further second crease line 93 of the basic unit 103.

The package 102 further comprises a back wall 48, interposed between the side wall 149 and the further side wall 150, which remains unchanged with respect to the package 2. Also, the top wall 45 and the bottom wall 46 remain unchanged.

The first border 83 and the second border 84 each extend between two vertexes V1, V2 respectively of the top wall 45 and of the bottom wall 46. Vertex V1 corresponds to point P2 on the basic unit 103, whereas vertex V2 corresponds to point Q2 on the basic unit 103.

Each one of the further first border 85 and the further second border 86 extends between two vertexes V3, V4 respectively of the top wall 45 and of the bottom wall 46. Vertexes V3, V4 respectively correspond to points P3, Q3 on the basic unit 103.

The package 102 has a height H that, in the example shown, is the distance between the top edge 42 and the corresponding bottom edge delimiting the back wall 48. The height H of the package 102 is equal to the distance between the top transverse crease line 4 and the bottom transverse crease line 6 on the basic unit 103.

The first corner panel 81 and the second corner panel 82 have a linear dimension, measured parallelly to the bottom wall 46, which varies along the height H of the package 102. This is due to the fact that the distance between the first border 83 and the second border 84 varies from the vertex V1 to the vertex V2. Similarly, the distance between the further first border 85 and the further second border 86 varies from vertex V3 to vertex V4.

Hence, the cross-section of the package 102 according to the second conformation does not have a rectangular or square shape. The cross-section of the package 102 varies along the height H and has generally the shape of a six-sided polygon. However, the bottom wall 46 has a quadrilateral, particularly rectangular, shape. More in detail, the bottom wall 46 has a width W1 and a depth D1.

The width W1, in the example shown, is the distance between the bottom edges that delimit the side wall 149 and the further side wall 150 respectively.

Since, in the example shown, the top wall 45 has the same shape and dimensions as the bottom wall 46, the top wall 45 and the bottom wall 46 have the same width W1.

The width W1 is also equal to the distance between points Q2 and Q3 (or P2 and P3) on the basic unit 103.

The depth D1, in the example shown, is the distance between the bottom edges that delimit the front wall 147 and the back wall 48. Since the top wall 45 has the same shape and dimensions as the bottom wall 46, the width W1 is also equal to the distance between the top edges that delimit the front wall 147 and the back wall 48.

The depth D1 is also equal to the distance between points P1 and P2 (or Q1 and Q2, or P3 and P4, or Q3 and Q4) on the basic unit 103.

Hence, at least one end cross-section of the package 102 according to the second conformation, namely the bottom wall 45 (and, in the example shown, also the top wall 46) has the same width W1 and the same depth D1 as the width W1 and the depth D1 of the package 2 according to the first conformation.

Packages 2 and 102 are obtained from respective sheet materials 1, 101 comprising basic units 3, 103 having the same length L and the same width W. If it is desired to switch production between packages 2 and 102, the folding devices used to fold the packaging material along the crease lines thereof on the packaging machine need to be changed. However, there is no need to change the advancement devices that advance the packaging material along the packaging machine, because the length L or pitch does not change. Hence, the modifications that need to be made on the packaging machine are limited.

The replacements and adjustments that need to be carried out on the packaging machine in order to change the conformation of the produced package are further decreased because the packages 2, 102 (produced from respective basic units 3, 103 having the same overall dimensions) have the same width W1 and the same depth D1, at least in one end cross-section of the package. This simplifies the operations to be carried out in order to change the configuration of the packaging machine.

Owing to the different conformation of the packages 2, 102, flexibility in the shape of the finished package can be achieved. Furthermore, the volume defined by the package 2 according to the first conformation differs from that defined by the package 102 according to the second conformation. This is due to the differences between the cross-section of the packages 2 and 102 along the height H.

Packages 2 and 102 can therefore be used to contain respective different quantities of products.

Although, in the embodiment disclosed with reference to FIGS. 1 to 4, the crease pattern 20 of the package 2 according to the first conformation and the crease pattern 120 of the package 102 according to the second conformation differ from each other only for the crease lines intended to form two adjacent longitudinal border zones of the respective packages, alternative embodiments could be provided in which the crease patterns 20, 120 differ from each other for the crease lines intended to define only one, or more than two, longitudinal border zones of the finished package.

Furthermore, the crease lines of the crease patterns 20 and 120 could also have a shape that is different from the shape shown in FIGS. 1 and 2. For example, the crease lines 90, 91 and/or 92, 93 could have a curved shape.

Finally, the crease lines of the crease pattern 20 and/or of the crease pattern 120 intended to define a first longitudinal border zone of the finished package may have a shape that is different from the shape of the crease lines of the crease pattern 20 and/or of the crease pattern 120 intended to define a second longitudinal border zone of the same finished package.

Figure 5:
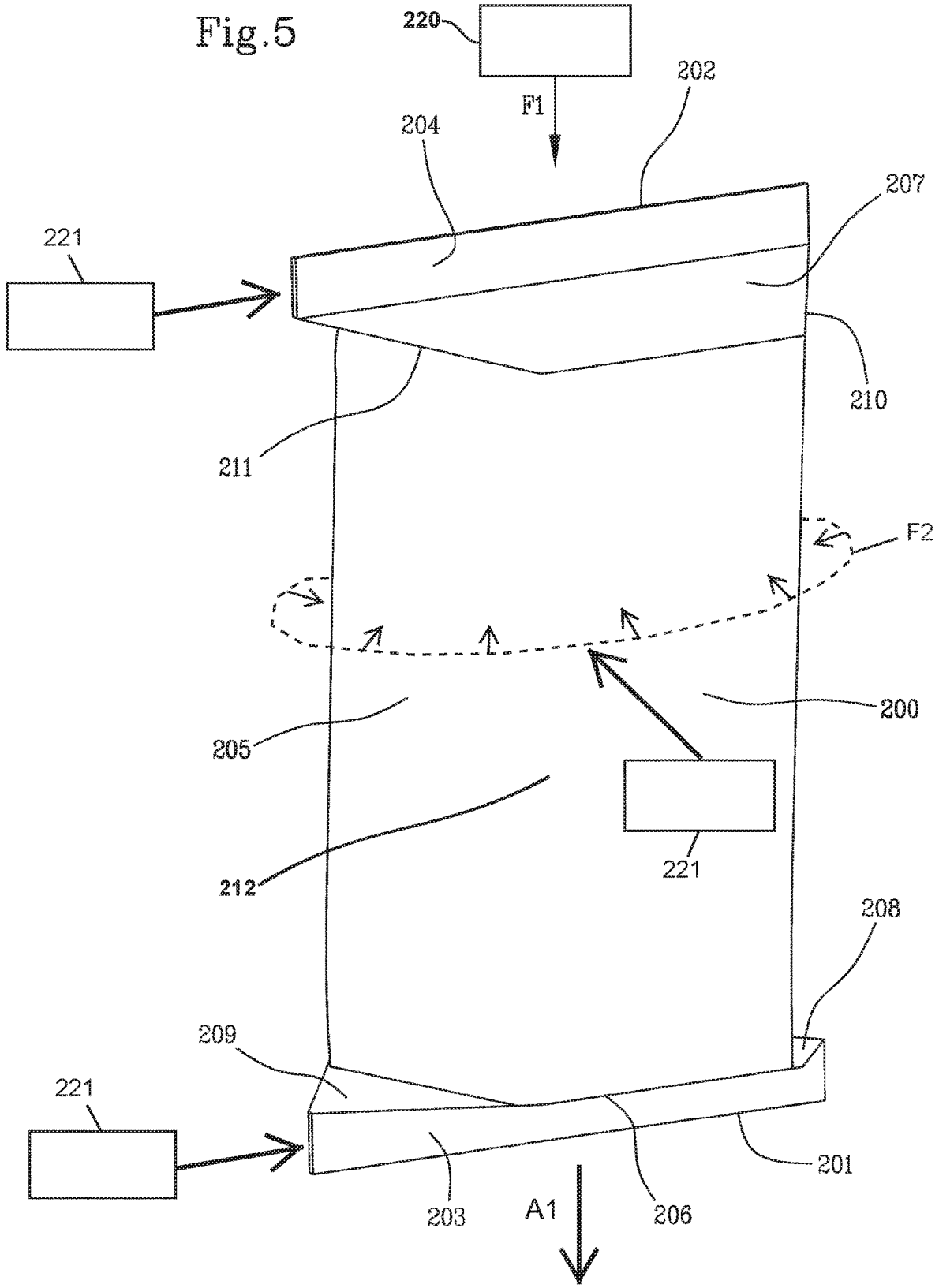
FIG. 5 is a schematic perspective view showing a step of obtaining a sealed preliminary packaging unit.
Figure 6:
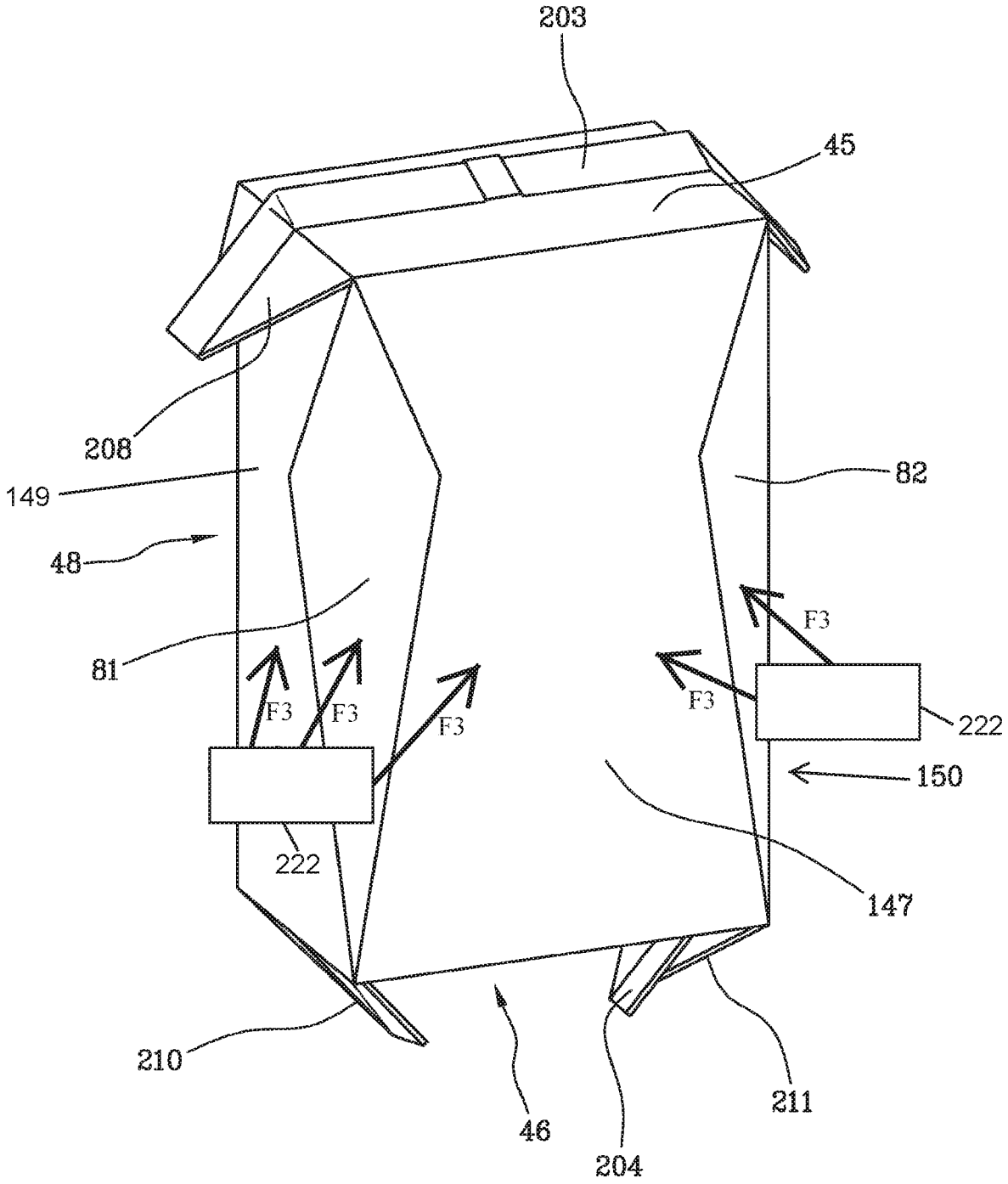
FIG. 6 is a schematic perspective view showing a step of forming a package from the sealed preliminary packaging unit.

The package 102 according to the second conformation may be produced by a method whose main steps are shown in FIGS. 5 and 6, such as method 700 shown in FIG. 7, which is discussed in detail below. The method is also applicable to the package 2 according to the first conformation or to other packages, particularly having a different shape of at least one longitudinal border zone.

A web of sheet packaging material, comprising a sequence of a plurality of basic units 103, is advanced along an advancement direction A1 for example by an advancement device 220 shown in FIG. 5 that exerts an advancement force F1 on the sheet packaging material. The advancement device 220 may comprise at least two pairs of gripping jaws that move synchronously along the advancement direction A1 supported by a driving chain or any other kind of driving device.

The web of sheet packaging material is sealed longitudinally, i.e. parallel to the advancement direction A1, in order to form a tube that is open at opposite ends thereof. To this end, the first longitudinal border 23 of the sheet packaging material 101 is laid over an overlapping band 30 adjacent to the second longitudinal border 24. The first longitudinal border 23 is then sealed to the overlapping band 30 by any suitable sealing technique.

The tube thus formed is further processed in order to obtain therefrom a sealed preliminary packaging unit 200 as shown in FIG. 5. The sealed preliminary packaging unit 200 is obtained by sealing the tube along a first transverse sealing band 203 and along a second transverse sealing band 204 that may be parallel to each other. The first transverse sealing band 203 and the second transverse sealing band 204 are arranged transversely, particular perpendicularly, to a longitudinal sealing band that has been created by sealing the sheet packaging material 101 along the overlapping band 30.

The first transverse sealing band 203 and the second transverse sealing band 204 extend transversely, particular perpendicularly, to the advancement direction A1.

The first transverse sealing band 203 may be intended to form the top transverse sealing band 44 of the package 102. Similarly, the second transverse sealing band 204 may be intended to form the bottom transverse sealing band of the package 102.

As shown in FIG. 5, the first transverse sealing band 203 is created when the sheet packaging material 101 is sealed by a volume defining arrangement 221 in a region interposed between the further top transverse crease line 5 and the first transverse border 21. The second transverse sealing band 204 is created when the sheet packaging material 101 is sealed by the volume defining arrangement 221 in a region interposed between the further bottom transverse crease line 7 and the second transverse border 22.

While the tube is being processed to obtain the sealed preliminary packaging unit 200 therefrom, and before completely sealing the sheet packaging material 101 along the second transverse sealing band 204, the product is introduced inside the tube, for example by means of known filling devices.

The sealed preliminary packaging unit 200 is delimited, transversely to the advancement direction A1, by a first transverse cutting line 201 and by a second transverse cutting line 202, which may be parallel to one another. More in detail, the first transverse cutting line 201 delimits the first transverse sealing band 203, whereas the second transverse cutting line 202 delimits the second transverse sealing band 204.

The first transverse cutting line 201 corresponds to the first transverse border 21 of the basic unit 103, whereas the second transverse cutting line 202 corresponds to the second transverse border 22 of the basic unit 103.

The first transverse cutting line 201 and the second transverse cutting line 202 may be obtained by any suitable cutting device that follows the sheet packaging material 101 as the latter advances along the advancement direction A1. For example, two pairs of jaws can be provided, particularly a first pair of jaws acting in an end region of the sealed preliminary packaging unit 200 near the first transverse cutting line 201 and a second pair of jaws acting in a further end region of the sealed preliminary packaging unit 200 near the second transverse cutting line 202. The first pair of jaws and the second pair of jaws each comprise a pair of opposite jaws that are movable between a disengagement position and a gripping position. In the gripping position, the sheet packaging material 101 is firmly gripped between the jaws of a pair, so that the sheet packaging material 101 may be advanced by the gripping jaws along the advancement direction A1. In the disengagement position, the gripping jaws are distanced from one another and do not interact with the sheet packaging material.

Each pair of gripping jaws may be provided with a sealing element of the volume defining arrangement 221 and with a cutting element for respectively forming either the first transverse sealing band 203 and the second transverse sealing band 204, and cutting the sheet packaging material 101 along either the first transverse cutting line 201 or the second transverse cutting line 202.

The sealed preliminary packaging unit 200 further comprises a first end region 206 located near the first transverse sealing band 203, so that the latter is interposed between the first transverse cutting line 201 and the first end region 206.

The first end region 206 is intended to form an end wall of the package 102, for example the top wall 45 thereof.

The first end region 206 is provided with a first lateral protrusion 208 and a further first lateral protrusion 209 that project from opposite zones of the first end region 206. The first lateral protrusion 208 and the further first lateral protrusion 209 are intended to form two triangular lateral flaps of the package 102, for example the lateral top flaps 27.

The sealed preliminary packaging unit 200 further comprises a second end region 207 opposite the first end region 206. The second end region 207 is located near the second transverse sealing band 204, so that the latter is interposed between the second transverse cutting line 202 and the second end region 207. The second end region 207 is intended to form a further end wall of the package 102, for example the bottom wall 46 thereof.

The second end region 207 is provided with a second lateral protrusion 210 and a further second lateral protrusion 211 that project from opposite zones of the second end region 207. The second lateral protrusion 210 and the further second lateral protrusion 211 are intended to form two triangular lateral flaps of the package 102, for example the lateral bottom flaps.

Between the first end region 206 and the second end region 207 a central portion 205 is interposed. The central portion 205 is intended to form the portion of the package 102 that is arranged between the bottom wall 46 and the top wall 45. The central portion 205 has a substantially constant cross-section.

FIG. 5 shows the sealed preliminary packaging unit 200 after the latter has interacted with the advancement device 220 (e.g., gripping jaws or other advancement devices). At this stage, the sheet packaging material 101 has been folded along the top transverse crease line 4 and the further top transverse crease line 5, so as to define the first end region 206.

Furthermore, the sheet packaging material 101 has been folded along the first oblique crease line 12, the second oblique crease line 13, the further first oblique crease line 14 and the further second oblique crease line 15, thereby defining the first lateral protrusion 208 and the further first lateral protrusion 209.

Similarly, the sheet packaging material 101 has been folded along the bottom transverse crease line 6, the further bottom transverse crease line 7, the first tilted crease line 16, the second tilted crease line 17, the further first tilted crease line 18 and the further second tilted crease line 19.

However, the sealed preliminary packaging unit 200 has been obtained by processing the sheet packaging material 101 without folding the latter along the longitudinal crease line 8, the first crease line 90, the second crease line 91, the further first crease line 92, the further second crease line 93 and the further crease line 11. In other words, the sealed preliminary packaging unit 200 is obtained without folding the sheet packaging material 101 along the crease lines interposed between the bottom transverse crease line 6 and the top transverse crease line 4 and extending transversely to these two transverse crease lines. In the example shown in FIG. 2, this means that the sealed preliminary packaging unit 200 is obtained without folding the sheet packaging material 101 along the crease lines joining the top transverse crease line 4 and the bottom transverse crease line 6.

In other words, the sealed preliminary packaging unit 200 is obtained by a mechanical arrangement such as the volume defining arrangement 221, which does not comprise components specifically intended to act on the sheet packaging material 101 in order to fold the latter along the crease lines 8, 90, 91, 92, 93, 11. The volume defining arrangement 221 is configured to give the central portion 205 a cross-sectional shape that is different from the cross-sectional shape of the finished package 102.

In particular, the sealed preliminary packaging unit 200, near the crease lines 8, 90, 91, 92, 93, 11, is delimited by respective rounded longitudinal areas 212. These rounded longitudinal areas 212 are different from the clearly defined edges that are usually obtained when folding a sheet packaging material along a crease line.

The volume defining arrangement 221 intended to obtain the sealed preliminary packaging unit 200 is configured to seal and cut the sheet packaging material 101, so that a preset volume is defined inside the sealed preliminary packaging unit 200. As shown in FIG. 5, the volume defining arrangement 221 may define this preset volume by exerting a squeezing force F2 to a certain extent the central portion 205 before completely sealing the sealed preliminary packaging unit 200. In order to exert squeezing force F2 on the central portion 205, the volume defining arrangement 221 is configured to contact the sheet packaging material 101, without however exerting a folding action on the crease lines 8, 90, 91, 92, 93, 11. For example, the volume defining arrangement 221 may include a pair of concave squeezing elements, which encircle the central portion 205 to exert the squeezing force F2. These concave squeezing elements may have a cross-section delimited for example by a rounded or curved profile. The squeezing elements, when interacting with the central portion 205, define a passage having a cross-section that is different from the cross-section of the finished package 200.

The volume defining arrangement 221 may therefore be configured to form the sealed preliminary packaging unit 200.

The volume defining arrangement 221 that forms the sealed preliminary packaging unit 200 is furthermore configured to fill the latter with a desired quantity of product, which is introduced inside the tube of sheet packaging material 101 before completely sealing the sealed preliminary packaging unit 200.

Downstream of the volume defining arrangement 221, there is provided a forming arrangement 222 for forming the sheet packaging material 101 of the sealed preliminary packaging unit 200, in order to obtain from the latter a finished package 102. FIG. 6 shows the package a few moments before the latter is given its final conformation.

As shown in FIG. 6, the sheet packaging material 101 defining the sealed preliminary packaging unit 200 is folded by the forming arrangement 222 along the longitudinal crease line 8 and the further longitudinal crease line 11, as well as along the first crease line 90, the second crease line 91, the further first crease line 92 and the further second crease line 93. Thus, the back wall 48, the side wall 149, the first corner panel 81, the front wall 147, the second corner panel 82 and the further side wall 150 are obtained.

In other words, the shape of the cross-section of the central portion 205 is modified by the forming arrangement 222, which exerts a folding force F3 on the sealed preliminary packaging unit 200 so as to give the central portion 205 the shape of the cross-section of the finished package 102.

The forming arrangement 222 also acts on the first end region 206 and on the second end region 207 of the sealed preliminary packaging unit 200, although these two end regions had already been partially formed by the volume defining arrangement 221.

In particular, the sheet packaging material 101 is folded more strongly along the top transverse crease line 4 and along the bottom transverse crease line 6, so as to originate a well-defined top wall 45 and bottom wall 46.

The first transverse sealing band 203 and the second transverse sealing band 204 are folded around the further top transverse crease line 5 and the further bottom transverse crease line 7 respectively, so as to be superimposed to the top wall 45 and to the bottom wall 46 respectively.

The first lateral protrusion 208 and the further first lateral protrusion 209 are further folded so as to become superimposed to the side wall 149 and to the further side wall 150.

Similarly, the second lateral protrusion 210 and the further second lateral protrusion 211 are further folded, until they become superimposed to the bottom wall 46.

A finished package 102 is thus obtained.

By providing a sealed preliminary packaging unit 200 that is obtained without folding the corresponding sheet packaging material 101 along the crease lines interposed between the top transverse crease line 4 and the bottom transverse crease line 6, stress on the sheet packaging material 101 is decreased. This is due to the fact that, along the crease lines interposed between the top transverse crease line 4 and the bottom transverse crease line 6, the sheet packaging material 101 is folded only once, namely by the forming arrangement 222.

Furthermore, the same volume defining arrangement may be used to produce packages having different shapes and consequently different volumes, thereby increasing flexibility of the packaging machine.

Figure 7:
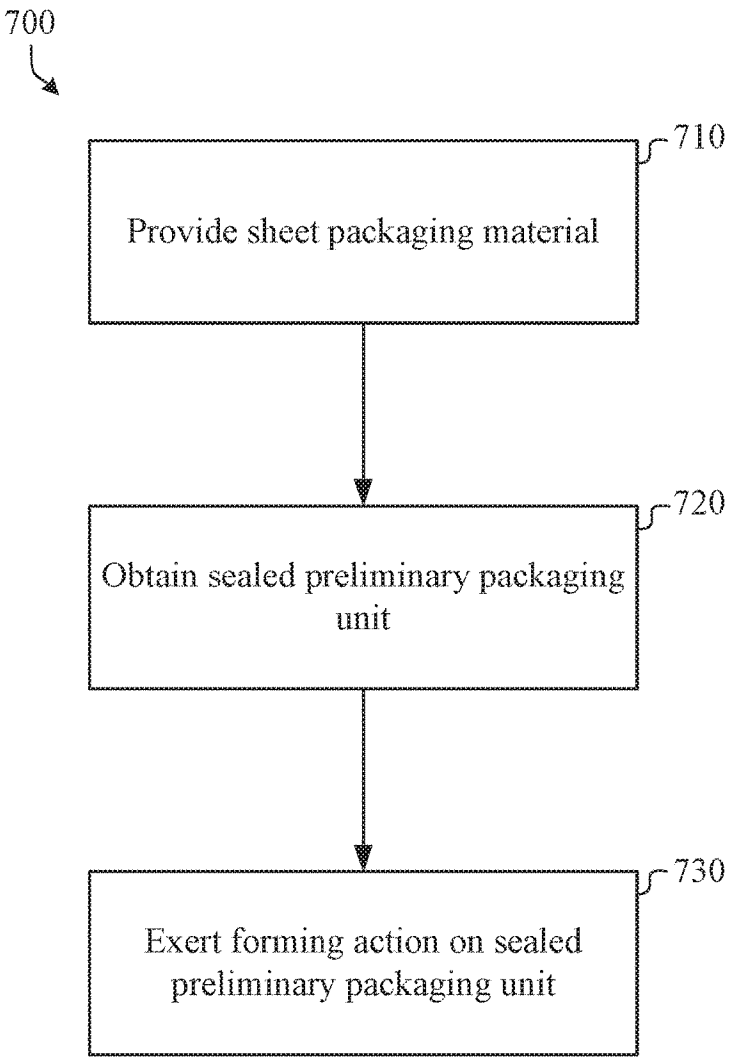
FIG. 7 is a flowchart of a method for producing a sealed package for a product.

In an example illustrated in FIG. 7, a method 700 for producing a sealed package for a product may include a step 710 of providing a sheet packaging material having a crease pattern, such as sheet packaging material 1 as shown in FIG. 1 or sheet packaging material 101 as shown in FIG. 2. The sheet packaging material may be provided without being folded along the further crease lines thereof (e.g., further crease lines 8-11 of crease pattern 20). Method 700 may also include a step 720 of obtaining a sealed preliminary packaging unit 200 from the sheet packaging material; step 720 is discussed in further detail below with reference to FIG. 8. Method 700 may also include a step 730 of exerting a forming action on the sealed preliminary packaging unit 200 so as to fold the sheet packaging material 101 defining the sealed preliminary packaging unit and obtain a package 102 therefrom. Step 730 may include, for example, exerting a folding force F3 on the sealed preliminary packaging unit 200 so as to fold the sheeting packaging material 101 in order to give the central portion 205 the shape of the cross-section of the finished package 102.

Figure 8:
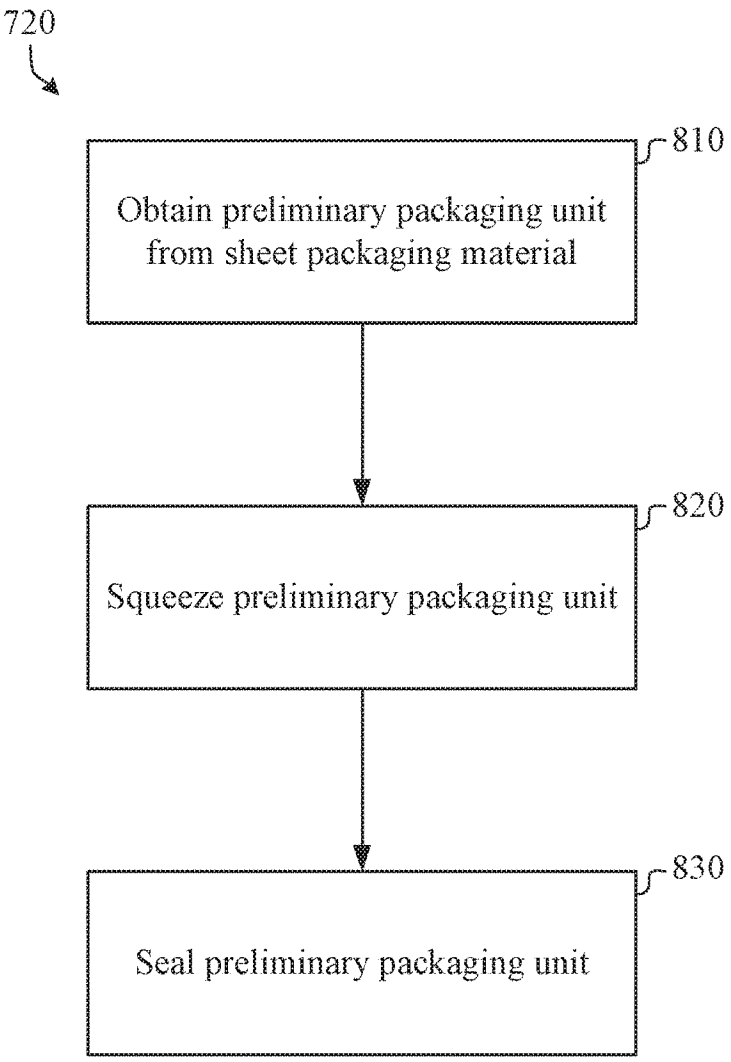
FIG. 8 is a flowchart of a step of the method of FIG. 7 for obtaining a sealed preliminary packaging unit.

In an example illustrate in FIG. 8, the obtaining step 720 may include sub-steps 810-830. In sub-step 810, a preliminary packaging unit may be obtained from the sheet packaging material 1, 101. In sub-step 820, the preliminary packaging unit may be squeezed to define a preset inner volume. For example, sub-step 820 may include exerting squeezing force F2 on the central portion 205 to define a cross-sectional shape thereof, without exerting a folding action on the crease lines 8, 90, 91, 92, 93, 11. In sub-step 830, the squeezed preliminary packaging unit may be sealed in order to obtain the sealed preliminary packaging unit 200 (for example, by the volume defining arrangement 221).

The invention claimed is:

1. A method for producing a sealed package for a product, the method comprising:

providing a sheet packaging material having a crease pattern, the crease pattern comprising at least a first transverse crease line and a second transverse crease line, the crease pattern further comprising a plurality of further crease lines interposed between the first transverse crease line and the second transverse crease line, the further crease lines extending transversely to the first transverse crease line and to the second transverse crease line, wherein the plurality of further crease lines is in an unfolded condition in the sheet packaging material;

obtaining a sealed preliminary packaging unit from the sheet packaging material by:

obtaining a preliminary packaging unit from the sheet packaging material, squeezing the preliminary packaging unit to define a preset inner volume, wherein squeezing the preliminary packaging unit comprises exerting a squeezing force on a central portion of the preliminary packaging unit to define a first cross-sectional shape of the central portion of the preliminary packaging unit, and sealing the squeezed preliminary packaging unit to obtain the sealed preliminary packaging unit, wherein the plurality of further crease lines remains in the unfolded condition in the sealed preliminary packaging unit, the sealed preliminary packaging unit having the preset inner volume and containing the product; and exerting a forming action on the sealed preliminary packaging unit so as to fold the sheet packaging material defining the sealed preliminary packaging unit and obtain the sealed package therefrom, the sealed package having a second cross-sectional shape that is different from the first cross-sectional shape.

2. The method according to claim 1, wherein the obtaining of the sealed preliminary packaging unit is performed while the sheet packaging material is being advanced in an advancement direction that is transverse to the first transverse crease line and to the second transverse crease line.

3. The method according to claim 2, wherein the obtaining of the sealed preliminary packaging unit comprises:

sealing the sheet packaging material longitudinally to form a continuous tube;

filling the tube with the product; and sealing and cutting the filled tube transversely with respect to the advancement direction to thereby obtain from the tube the sealed preliminary packaging unit.

4. The method according to claim 3, wherein sealing and cutting the filled tube comprises:

while the sheet packaging material is advanced along the advancement direction, sealing the tube along a first transverse sealing band and along a second transverse sealing band, the first and second transverse sealing bands being parallel to each other and being arranged transversely to a longitudinal sealing band forming the continuous tube.

5. The method according to claim 4, further comprising:

forming a first end region of the sealed preliminary packaging unit, the first end region being adjacent to the first transverse sealing band and including at least one first end lateral flap;

forming a second end region of the sealed preliminary packaging unit opposite from the first end region, the second end region being adjacent to the second transverse sealing band and including at least one second end lateral flap; and folding the first end lateral flap and the second end lateral flap in the same longitudinal direction.

6. The method according to claim 5, wherein folding the first end lateral flap and the second end lateral flap comprises:

folding the first end lateral flap to be superimposed to a side wall of the sealed package; and folding the second end lateral flap to be superimposed to an end wall of the sealed package.

7. The method according to claim 6, wherein the side wall of the sealed package is transverse to the end wall of the sealed package.

8. The method according to claim 1, wherein the sealed preliminary packaging unit is delimited, at portions thereof adjacent to each one of the unfolded further crease lines, by respective rounded longitudinal areas extending between the first transverse crease line and the second transverse crease line of the sheet packaging material defining the sealed preliminary packaging unit.

9. The method according to claim 1, wherein exerting the forming action on the sealed preliminary packaging unit comprises:

folding the sheet packaging material along the further crease lines to produce the sealed package.

10. The method according to claim 1, wherein the further crease lines join the first transverse crease line to the second transverse crease line.

11. The method according to claim 1, wherein the further crease lines comprise:

at least two crease lines extending between two common points, the at least two crease lines defining, on the sealed package, two respective borders that delimit a corner panel, the corner panel being interposed between a side wall and a front wall of the sealed package.

12. The method according to claim 11, wherein the at least two crease lines each have a concave shape, with respective concavities of the at least two crease lines facing one another.

13. The method according to claim 11, wherein each one of the at least two crease lines is selected from a group comprising:

a curved crease line, a crease line defined by a sequence of at least two straight crease segments, and a combination of a curved crease line and a straight crease segment.

14. The method according to claim 1, wherein exerting the squeezing force on the central portion of the preliminary packaging unit holds the further crease lines in the unfolded condition.

15. A machine for producing a sealed package for a product, the machine comprising:

an advancement device configured to advance a sheet packaging material having a crease pattern, the crease pattern comprising at least a first transverse crease line and a second transverse crease line, the crease pattern further comprising a plurality of further crease lines interposed between the first transverse crease line and the second transverse crease line, the further crease lines extending transversely to the first transverse crease line and to the second transverse crease line;

a volume defining arrangement configured to obtain a sealed preliminary packaging unit from the sheet packaging material by:

obtaining a preliminary packaging unit from the sheet packaging material, squeezing the preliminary packaging unit to define a preset inner volume, wherein squeezing the preliminary packaging unit comprises exerting a squeezing force on a central portion of the preliminary packaging unit to define a first cross-sectional shape of the central portion of the preliminary packaging unit, and sealing the squeezed preliminary packaging unit to obtain the sealed preliminary packaging unit containing the product, the preset inner volume being defined inside the sealed preliminary packaging unit, wherein the volume defining arrangement is configured to obtain the sealed preliminary packaging unit without folding the sheet packaging material along the further crease lines; and a forming arrangement configured to exert a forming action on the sealed preliminary packaging unit so as to fold the sheet packaging material defining the sealed preliminary packaging unit and obtain the sealed package therefrom, the sealed package having a second cross-sectional shape that is different from the first cross-sectional shape.

16. The machine according to claim 15, wherein the forming arrangement is configured to fold the sheet packaging material making up the sealed preliminary packaging unit along the further crease lines.

17. The machine according to claim 15, wherein exerting the squeezing force on the central portion of the preliminary packaging unit holds the further crease lines in an unfolded condition.

18. The machine according to claim 15, wherein the volume defining arrangement is configured to:

form a first end region of the sealed preliminary packaging unit, the first end region being adjacent to a first transverse sealing band of the sealed preliminary packaging unit and including at least one first end lateral flap; and form a second end region of the sealed preliminary packaging unit opposite from the first end region, the second end region being adjacent to a second transverse sealing band of the sealed preliminary packaging unit and including at least one second end lateral flap, wherein the first and second transverse sealing bands are parallel to each other and are arranged transversely to a longitudinal sealing band of the sealed preliminary packaging unit.

19. The machine according to claim 18, wherein the forming arrangement is configured to:

fold the first end lateral flap to be superimposed to a side wall of the sealed package; and fold the second end lateral flap to be superimposed to an end wall of the sealed package, wherein the side wall of the sealed package is transverse to the end wall of the sealed package.

* * * * *